US005769547A

United States Patent [19]

Igarashi

[11] Patent Number: 5,769,547

[45] Date of Patent: Jun. 23, 1998

[54] THERMAL PRINTER WITH PAD FOR CLEANING TRANSFER SHEET

[75] Inventor: Hitoshi Igarashi, Tokyo, Japan

[73] Assignee: Max Co., Ltd., Tokyo, Japan

[21] Appl. No.: 698,916

[22] Filed: Aug. 16, 1996

[30] Foreign Application Priority Data

| | | | |
|---|---|---|---|
| Aug. 18, 1995 | [JP] | Japan | 7-210755 |
| Aug. 18, 1995 | [JP] | Japan | 7-210756 |
| Sep. 1, 1995 | [JP] | Japan | 7-225530 |

[51] Int. Cl.[6] ..... B41J 2/325; B41J 35/28

[52] U.S. Cl. ..... 400/120.01; 400/208

[58] Field of Search ..... 400/120.01, 208

[56] References Cited

U.S. PATENT DOCUMENTS

| | | | |
|---|---|---|---|
| 3,586,437 | 6/1971 | Dietz | 101/228 |
| 4,084,682 | 4/1978 | Fairey et al. | 197/168 |
| 5,200,760 | 4/1993 | Ujihara et al. | 346/76 PH |
| 5,269,612 | 12/1993 | Shimoha et al. | 400/207 |
| 5,555,009 | 9/1996 | Hevenor et al. | 347/198 |

FOREIGN PATENT DOCUMENTS

| | | | |
|---|---|---|---|
| 466194 | 1/1992 | European Pat. Off. . | |
| 62-51470 | 3/1987 | Japan | 400/208 |
| 62-249784 | 10/1987 | Japan . | |
| 63-170058 | 7/1988 | Japan | 400/208 |
| 1-146782 | 7/1989 | Japan | 400/208 |
| WO 87/06527 | 5/1987 | WIPO . | |

*Primary Examiner*—Edgar S. Burr
*Assistant Examiner*—Daniel J. Colilla
*Attorney, Agent, or Firm*—Jacobson, Price, Holman & Stern, PLLC

[57] ABSTRACT

A thermal printer includes a sprocket wheel (11) for forwarding sheets, a platen roller (9), a thermal head (26) pressed on the platen roller (9), and a reduction gear (8) by which a rotating drive of a motor is reduced and is communicated to the sprocket wheel (11) and the platen roller (9). The sprocket wheel (11) is engaged with perforations (33) of a transfer sheet (4), and the transfer sheet (4) and an ink ribbon (21) are forwarded while being tightly sandwiched between the platen roller (9) and the thermal head (26), and the ink of the ink ribbon (21) is thermally transferred onto the transfer sheet (4) by the thermal head (26). In the thermal printer, a gear (10) with a friction clutch is disposed between the platen roller (9) and the reduction gear (8), and the peripheral speed of the platen roller (9) is set to be higher than that of the sprocket wheel (11). A torque limitation value of the friction-clutch gear (10) is set equal to or less than a feeding load imposed between the transfer sheet (4) and the ink ribbon (21).

6 Claims, 6 Drawing Sheets

THERMAL PRINTER WITH PAD FOR CLEANING TRANSFER SHEET

BACKGROUND OF THE INVENTION

1. Field of the Invention

This invention relates to a thermal printer for forming display sheets or the like.

2. Description of the Prior Art

A thermal printer Is known which is capable of forming, for example, display labels by thermally transferring characters or figures onto a pressure-sensitive adhesive sheet to which a released sheet of paper is attached. In the thermal printer, an ink ribbon and a transfer sheet of paper are moved forwards in a state in which they are tightly sandwiched between a platen roller and a thermal head. The conventional thermal printer is constructed to be applicable to a tape used as a transfer sheet which is several centimeters in width or to a broader tape available for display.

A platen roller of this type of thermal printer is rotated by a motor. Following the rotation of the platen roller, an ink ribbon and a transfer sheet which are in contact with each other are moved forwards, and characters or the like are thermally transferred to the transfer sheet by means of a thermal head. Thereafter, the transfer sheet on which the characters have been printed is discharged from the printer and, at the same time, the ink ribbon is wound on a winding spool inside of a cartridge. The winding spool is rotated and driven by the motor.

This type of conventional thermal printer is at a disadvantage in that printing-results satisfactory in dimensional accuracy cannot be obtained because there occurs an error in the quantity of movement of the transfer sheet. The error is caused by a slide between the transfer sheet and the platen roller because of the frictional resistance of the thermal head and the back tension of the ink ribbon, or is caused by a manufacturing inaccuracy of the platen roller, or is caused by a change in external diameter of the platen roller because of a temperature change.

As a solution to this disadvantage, there is known a large-sized thermal printer using wider sheets in which a sprocket wheel for forwarding sheets is included in addition to the platen roller, and a transfer sheet is used which has perforations formed at both the edges of the transfer sheet for engagement with the sprocket wheel so as to improve the dimensional accuracy of printing results. In this thermal printer, sheet forwarding is carried out by the platen roller and the sprocket wheel, and the quantity of movement of the transfer sheet is controlled by the sprocket wheel, so that an error in the movement quantity thereof which is caused by, for example, a slide between the platen roller and the transfer sheet can be lessened and thereby the dimensional accuracy of the printing results can be heightened.

A thermal printer having a sheet forwarding system which comprises a sprocket wheel and a platen roller is constructed to drive the sprocket wheel and the platen roller synchronously. However, it is not easy to equalize the peripheral speed of the sprocket wheel with that of the platon roller because of a machining tolerance etc. If the peripheral speeds of them do not coincide with each other, cases frequently occur in which unsatisfactory printing is carried out because of a loose state of the transfer sheet and the ink ribbon between the platen roller and the sprocket wheel, or the perforations of the transfer sheet which are in engagement with the sprocket claws of the sprocket wheel are deformed because of excessive tension and, as a result, a positional slip relative to each other is brought about between the sprocket wheel and the transfer sheet and accordingly an error in the sizes of characters to be printed is generated. Disadvantageously, this error lowers the quality of the printed characters.

SUMMARY OF THE INVENTION

It is an object of the present invention to provide a thermal printer which is capable of heightening the quality of printed characters by eliminating a difference in sheet forwarding between a sprocket wheel and a platen roller.

According to the present invention, a thermal printer comprises a sprocket wheel for forwarding sheets, a platen roller, a reel shaft for winding an ink ribbon, and a thermal head pressed on the platen roller. The sprocket wheel, the platen roller, and the reel shaft are rotated by a motor. The sprocket wheel is engaged with perforations formed at both the edges of a longitudinal transfer sheet of paper and, with the transfer sheet and the sprocket wheel tightly sandwiched between the platen roller and the thermal head, the transfer sheet and the ink ribbon are forwarded in accordance with the movement of the platen roller and the thermal head. The ink of the ink ribbon is then transferred thermally onto the transfer sheet by means of the thermal head. In the thermal printer, the platen roller is rotated and driven by the motor through the aid of a torque limiting means, and the peripheral speed of the platen roller is set to be higher than that of the sprocket wheel, and further a torque limitation value determined by the torque limiting means is set equal to or less than a feeding load imposed between the transfer sheet and the ink ribbon.

DETAILED DESCRIPTION OF THE EMBODIMENTS

Embodiments of a thermal printer according to the present invention will be hereinafter described with reference to the accompanying drawings.

Figure 1:
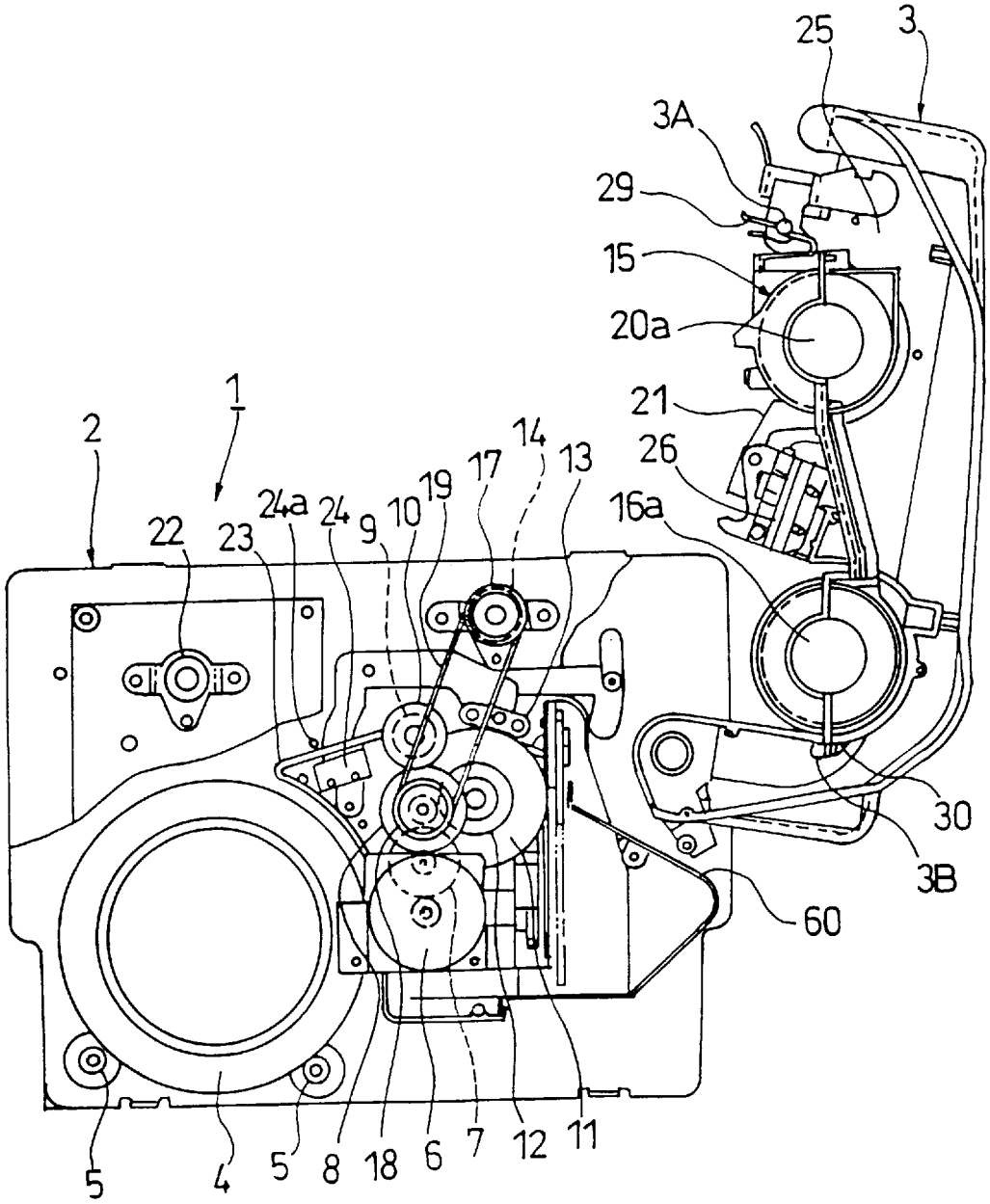
FIG. 1 is a partially broken side view of a thermal printer according to the present invention, showing a state in which an upper cover of the thermal printer is opened.

A thermal printer 1 shown in FIG. 1 has a frame 2 and an upper cover 3 pivoted on the frame 2. The upper cover 3 can freely open and shut. A pair of supporting rollers 5, 5 for supporting a transfer sheet 4 wound on a core (a feeding roller), not shown, are disposed at the lower part of the rear (on the left-hand side in FIG. 1) inside of the frame 2. A stepping motor 6 is disposed in the front of the frame 2.

Figure 2:
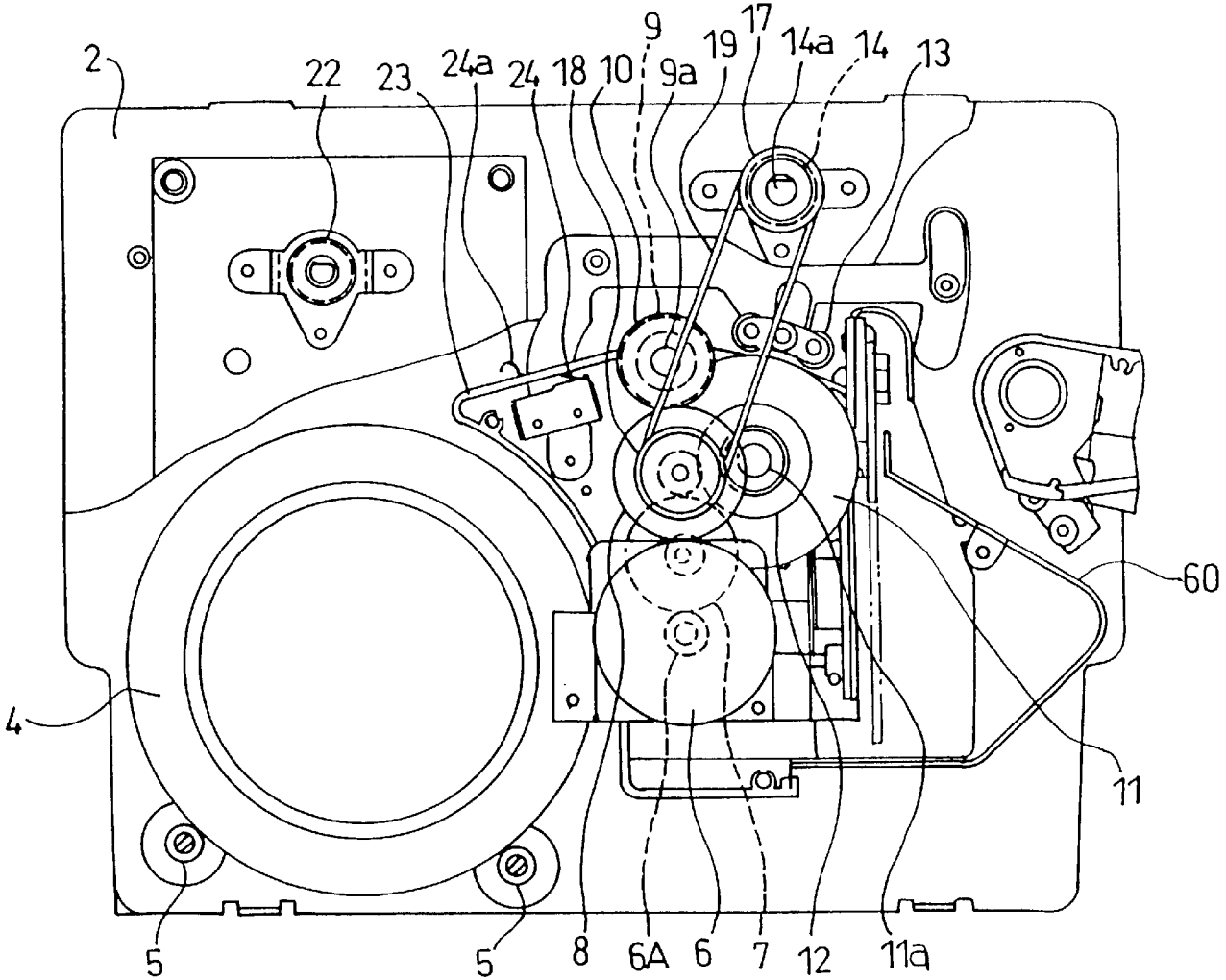
FIG. 2 is a partially broken side view of a sheet forwarding system of the thermal printer of FIG. 1.

As shown in FIG. 2, a driving gear 6A of the stepping motor 6 is engaged with a first reduction gear 7 in which large and small gears in diameter are coaxially formed. The first reduction gear 7 is engaged with a second reduction gear 8 in which large and small gears in diameter are coaxially formed. A gear 10 having a friction clutch is attached to a shaft 9*a* of a platen roller 9 disposed above the second reduction gear 8, so that the friction-clutch gear 10 is engaged with the large-diameter gear of the second reduction gear 8. A sprocket wheel 11 is disposed in the front of the second reduction gear 8. A gear 12 engaged with the small-diameter gear of the second reduction gear 8 is attached to a shaft 11*a* of the sprocket wheel 11.

The peripheral speed of the platen roller 9 on which no load is imposed is set to be higher than that of the sprocket wheel 11 by setting an external-diameter ratio between the platen roller 9 and the sprocket wheel 11 and a reduced-speed ratio between the friction-clutch gear 10 and the gear 12 by means of the reduction gear 8.

The construction of the friction-clutch gear 10 is well known. A limitation value of torque of the friction-clutch gear 10 is determined by a spring constant, and a torque value of the platen roller 9 is limited to a predetermined value regardless of the torque transferred to the gear. The torque limitation value of the friction-clutch gear 10 used here is set equal to or less than the feeding load imposed between the transfer sheet and the ink ribbon.

The pair of right and left sprocket wheels 11 connected to the sprocket wheel shaft 11*a* are located to be engaged with perforations formed at both the edges of the transfer sheet 4. A sheet holding roller 13 capable of moving upward and downward is disposed above the pair of right and left sprocket wheels 11. The sheet holding roller 13 is pressed on the peripheral surfaces of the sprocket wheels 11 by the force of a spring (not shown) so as to hold the transfer sheet 4 engaged with the sprocket wheels 11.

A gear 14 for winding an ink ribbon is disposed above the sprocket wheels 11 inside of the frame 2. The gear 14 is engaged with gears 16*a* of a winding spool 16 of an ink ribbon cartridge 15 shown in FIG. 3 and thereby drives the winding spool 16. A gear shaft 14*a* of the ink-ribbon winding gear 14 protrudes from the frame 2. A pulley 17 is fitted on the gear shaft 14*a*. A belt 19 is stretched between the pulley 17 and a pulley 18 fitted on the shaft of the second reduction gear 8. Driving force is communicated from the second reduction gear 8 to the ink-ribbon winding gear 14.

A gear 22 with a brake is disposed in the rear of the ink-ribbon winding gear 14. The gear 22 is engaged with gears 20*a* of a supply spool 20 of the ink ribbon cartridge 15 and thereby gives back tension to an ink ribbon 21.

A transfer-sheet guiding plate 23 is disposed in the rear of the platen roller 9. A microswitch 24 is attached to the reverse of the transfer-sheet guiding plate 23. A button 24*a* at an end of an operating lever of the microswitch 24 protrudes upward through a hole (not shown) formed in the transfer sheet guiding plate 23.

When the platen roller 9 is fed with the transfer sheet 4, the button 24*a* of the microswitch 24 is designed not to protrude upward from the hole because of the presence of the transfer sheet 4. When the rear end of the transfer sheet 4 passes through the transfer sheet guiding plate 23, the button 24*a* is pushed out upward through the hole. Responding to the protrusion of the button 24*a*, the microswitch 24 is turned on to output a completion signal of the transfer sheet 4.

A cartridge chamber 25 in which the ink ribbon cartridge 15 is mounted is formed in the upper cover 3. A thermal head 26 is disposed in the middle in forward and backward directions of the cartridge chamber 25 and is situated between the supply spool 20 of the ink ribbon cartridge 15 and the winding spool 16.

Figure 3A:
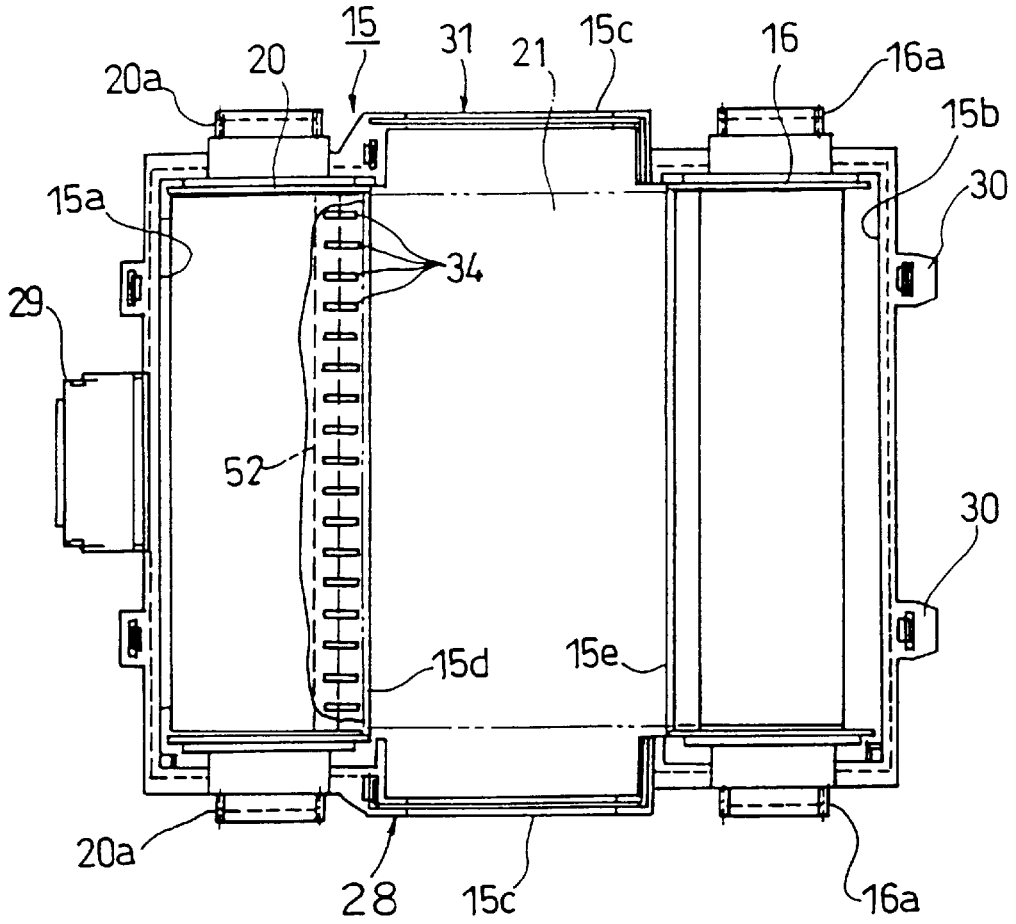
FIG. 3(*a*) is a top view of an ink ribbon cartridge, showing a state in which an upper case is removed from the cartridge, and FIG. 3(*b*) is a side view of the ink ribbon cartridge, showing a state in which the upper case is attached thereto.
Figure 3B:
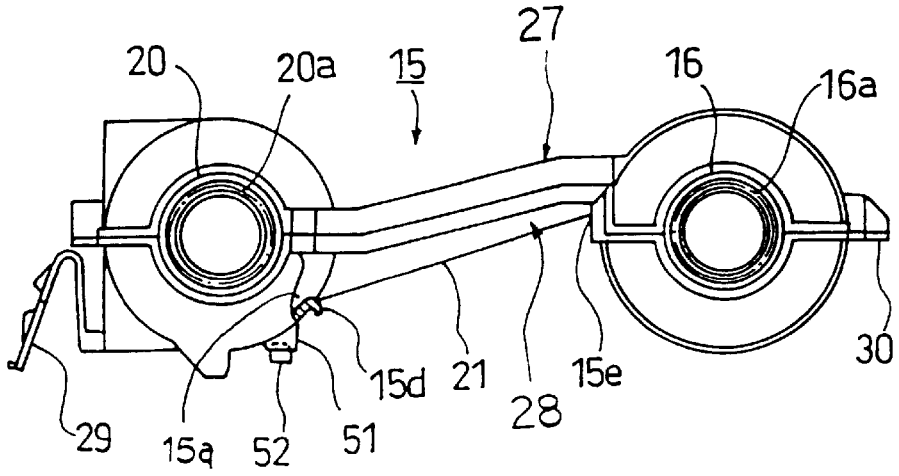

FIGS. 3(i a) and 3(*b*) show the ink ribbon cartridge 15. FIG. 3(*a*) shows a state in which an upper case 27 of the cartridge 15 is removed. As shown in FIG. 3(*a*), the winding spool 16 and the supply spool 20 are supported on axes in the front and rear parts of a rectangular lower case 28, respectively. The ink ribbon 21 is wound from the supply spool 20 in the rear part to the winding spool 16 in the front part. The gears 20*a*, 16*a* formed at both the lateral ends of the supply spool 20 and the winding spool 16 are engaged with the gear 22 and the ink ribbon winding gear 14, respectively.

Engagement claws 30, 29 are formed at the front and rear ends of the lower case 28, respectively. The engagement claws 30, 29 are engaged with engagement portions 3B, 3A formed in the cartridge chamber 25 of the upper cover 3 shown in FIG. 1, respectively. Thereby, the ink ribbon cartridge 15 is mounted in the cartridge chamber 25.

A pad mounting seat 51 substantially equal in width to the ink ribbon 21 is disposed on the bottom surface of the lower case 28 under the supply spool 20. The pad mounting seat 51 has a concave portion (not shown) in which a urethane pad 52 is pressed and fixed. The pad 52 protrudes downward from the pad mounting seat 51 and is brought into contact with the upper surface (transferred surface) of the transfer sheet 4 when printing is carried out.

A semi-cylindrical ink ribbon guide 15*d* is formed in a room 15*a* of the ink ribbon cartridge 15 in which the supply spool 20 is placed. As shown in FIGS. 3(*a*) to 4, a plurality of grooves 34 each of which extends in a direction in which the ink ribbon 21 is forwarded are formed parallel to each other in the surface of the guide 15*d*.

Figure 4:
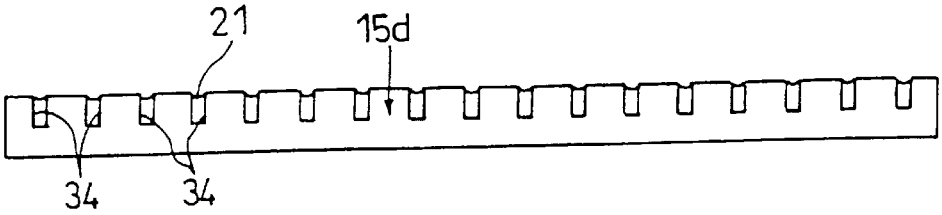
FIG. 4 is a descriptive drawing showing an ink ribbon guide.

As shown in FIG. 4, the heat-sensitive ink ribbon 21 comes into contact with a contact surface of the ink ribbon guide 15*d* and goes slightly into the grooves 34 by the back tension. The ink ribbon guide 15*d* has a function of regulating the movement in a lateral direction of the ink ribbon 21. According to the function, stress in the lateral direction caused by the partial disorder of the back tension is divided and absorbed by a number of contact portions of the guide 15*d* separated by the grooves 34, and thereby the movement in the lateral direction of the ink ribbon 21 is regulated. Accordingly, the stress in the lateral direction is prevented from concentrating upon a point or several points, so that the heat-sensitive ink ribbon 21 can be fed to the thermal head 26 in a tightening state without making creases.

As shown in Pigs. 5(*a*) and 5(*b*), the transfer sheet 4 comprises a sheet film 31 made of polyethylene resin, vinyl chloride resin, or the like, and a released sheet 32 of paper which adheres to an adhesive layer formed in the back of the sheet film 31. Circular perforations 33 are evenly spaced at the right-hand and left-hand edges of the sheet film 31 and the released sheet 32 with respect to a forwarding direction.

Figure 6:
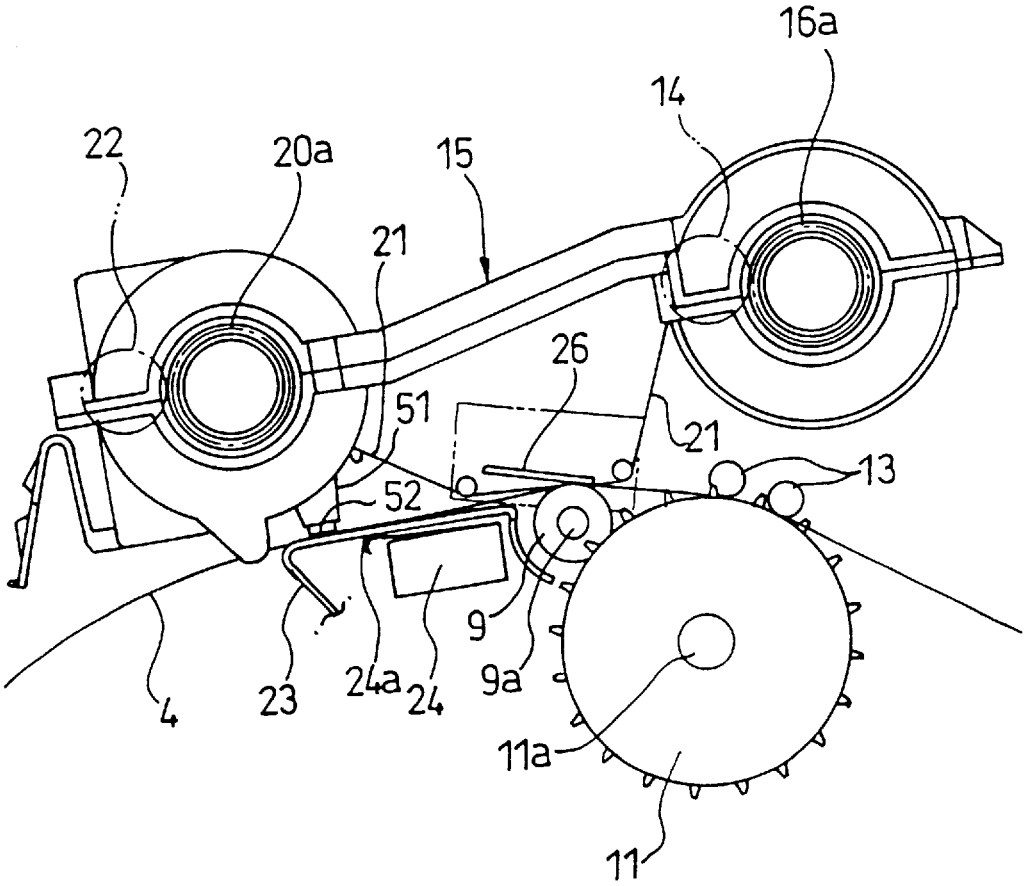
FIG. 6 shows a state in which characters are printed by the thermal printer of FIG. 1.

As shown in FIG. 1, a roll of the transfer sheet 4 is mounted on the supporting rollers 5, 5, and the forefront of the transfer sheet 4 is laid on the platen roller 9 and the sprocket wheel 11 and then is drawn from a sheet discharging outlet 60 formed in the front. Thereafter, the perforations 33 are engaged with the sprocket wheel 11, and the upper cover 3 in which the ink ribbon cartridge 15 is set is shut. Thereby, as shown in FIG. 6, the transfer sheet 4 and the ink ribbon 21 are pressed by both the thermal head 26 and the platen roller 9.

When printing is performed, data about characters to be printed is successively transferred from a control unit (not shown) to the thermal head 26. Simultaneously, the stepping motor 6 and the thermal head 26 are driven synchronously, and the transfer sheet 4 and the ink ribbon 21 are forwarded by the platen roller 9. Thereafter, the ink ribbon 21 is wound on the winding spool 16, and then the transfer sheet 4 is discharged from the sheet discharging outlet 60 by means of the sprocket wheel 11.

At this time, since a torque of the platen roller 9 is limited to a value equal to or less than the feeding load of the transfer sheet 4 and the ink ribbon 21 by means of the friction-clutch gear 10, the forwarding speed of the platen roller 9 is prevented from becoming higher than that of the sprocket wheel 11. If the forwarding speed of the platen roller 9 be higher than that of the sprocket wheel 11, a torque of the platen roller 9 becomes equal to or larger than the aforementioned feeding load, so that the friction-clutch gear 10 idles with respect to the platen roller 9. Accordingly, the forwarding speed of the platen roller 9 can be prevented from becoming higher than that of the sprocket wheel 11.

In addition, since the peripheral speed of the platen roller 9 is set to be higher than that of the sprocket wheel 11, the forwarding speed of the platen roller 9 can be prevented from becoming lower than that of the sprocket wheel 11. As a consequence, the platen roller 9 is rotated synchronously with a forwarded quantity of the transfer sheet 4 forwarded by the sprocket wheel 11.

Accordingly, the peripheral speed of the platen roller 9 is automatically controlled to be equal to that of the sprocket wheel 11 without slacking the transfer sheet 4 and the ink ribbon 21. In addition, since the platen roller 9 and the sprocket wheel 11 are interrelatedly rotated to forward the transfer sheet 4 and the ink ribbon 21, the feeding load of the transfer sheet 4 in the sprocket wheel 11 is so slight that the deformation of the perforations 33 does not occur.

In addition, since the Pad 52 fixed to the pad mounting seat 51 is in contact with the upper surface of the transfer sheet 4 during printing, dust adhering to the upper surface of the transfer sheet 4 is swept away, and the swept dust is absorbed by the static electricity generating in the pad 52. Consequently, since the transfer sheet 4 reaches the thermal head 26 in a state in which the transfer sheet 4 from which the dust has been removed is in close contact with the ink ribbon 21, inferiority in printing quality caused by the dust does not occur.

In the aforementioned embodiment, the friction-clutch gear 10 is used. However, instead of the friction-clutch gear 10, a ball-clutch gear, for example, may be used, of course.

Figure 7:
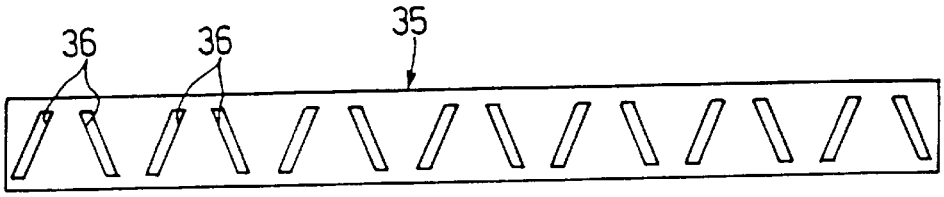
FIG. 7 is a descriptive drawing showing another example of the ink ribbon guide.

FIGS. 7 to 10 show other embodiments of the ink ribbon guide 15*d* shown in FIG. 4. Referring to FIG. 7, a groove 36 inclined rightward at a predetermined angle and a groove 36 inclined leftward at a predetermined angle with respect to the forwarding direction are alternately arranged in an ink ribbon guide 35. According to this arrangement, the ink ribbon guide 35 can obtain an advantageous effect by which an extending force and a converging force in the direction of width interact with each other and, as a result, uneven back tension is wholly made uniform.

Figure 8:
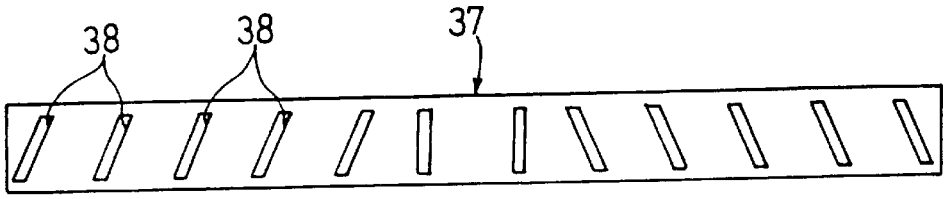
FIG. 8 is a descriptive drawing showing still another example of the ink ribbon guide.

Referring to FIG. 8, grooves 38 in the right-hand half (in the drawing) of an ink ribbon guide 37 are inclined at a determined angle whereas grooves 38 in the left-hand half of the ink ribbon guide 37 are inclined opposite to those in the right-hand half. According to this arrangement shown in FIG. 8, an extending force acts on the ink ribbon 21 in the directions of both edges of the ink ribbon 21 and thereby the ink ribbon 21 is prevented from creasing.

Figure 9:
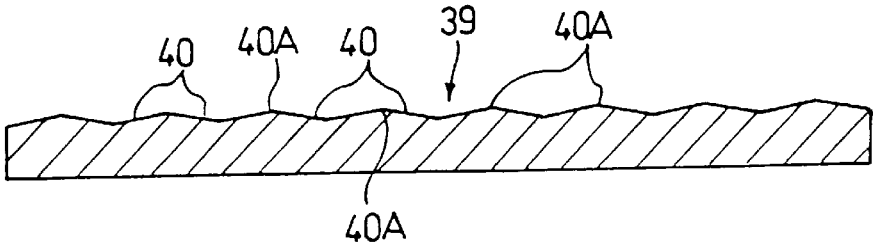
FIG. 9 is a descriptive drawing showing still another example of the ink ribbon guide.

Referring to FIG. 9, an ink ribbon guide 39 has inclined surfaces 40 extending from tops 40A. The occurrence of creases of the ink ribbon 21 can be prevented by stretching the ink ribbon 21 in the right and left directions on the inclined surfaces 40.

Figure 10:
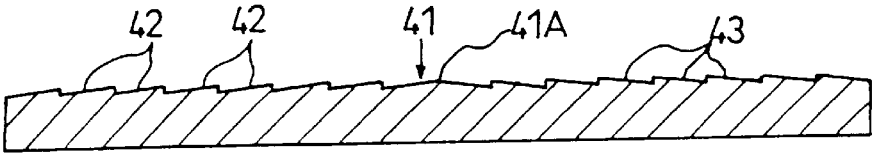
FIG. 10 is a descriptive drawing showing still another example of the ink ribbon guide.
Figure 5B:
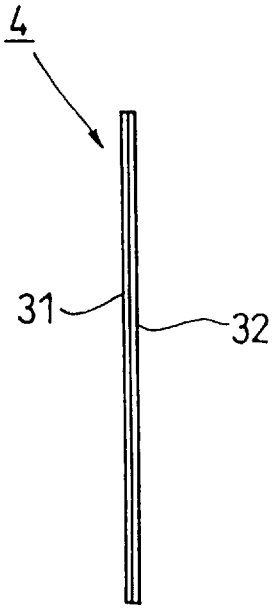
FIG. 5(*a*) is a plan view of a transfer sheet of paper, and FIG. 5(*b*) is a sectional view of the transfer sheet.
Figure 5A:
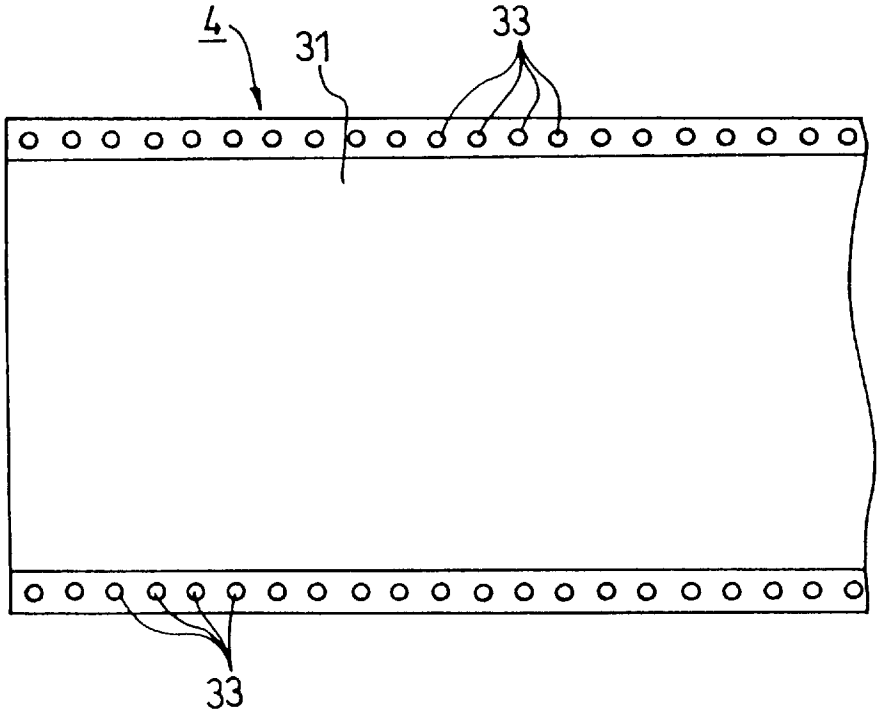

Referring to FIG. 10, an ink ribbon guide 41 is a modification of the ink ribbon guide 39 shown in FIG. 9. A plurality of inclined surfaces 42, 43 are formed in the ink ribbon guide 41. The inclined surfaces 43 in the right-hand half (in the drawing) of the ink ribbon guide 41 are inclined rightward with respect to the center 41A thereof whereas the inclined surfaces 43 in the left-hand half (in the drawing) of the ink ribbon guide 41 are inclined leftward with respect to the center 41A. Each inclined surface is contiguous to a vertical surface.

In the ink ribbon guides 39, 41 shown in FIGS. 9 and 10, the inclined surfaces 40, 42, 43 serve to divide and absorb the stress in the lateral direction caused by the partial disorder of back tension, so that the ink ribbon 21 can be prevented from converging or shrinking in the direction of its width. Accordingly, the ink ribbon guides 39, 41 can obtain the same advantageous effect as the aforementioned ink ribbon guides 15*d*, 35, 37.

Only the embodiments in which the ink ribbon guide is disposed in the ink ribbon cartridge 15 are shown in the attached drawings. However, the present invention is not limited to the aforementioned embodiments. For example, an ink ribbon guide may be disposed in an ink ribbon passage of the thermal printer 1 and be brought into contact with a heat-sensitive ink ribbon. Moreover, the shape of the ink ribbon guide can be varied within the technical scope of the present invention and, of course, the present invention is applicable to these variants.

What is claimed is:

1. A thermal printer comprising:

a sprocket wheel and a platen roller, each rotated and driven by a motor, for forwarding sheets;

a thermal head pressed on said platen roller;

an ink cartridge; wherein said sprocket wheel is engaged with perforations formed at both edge portions in longitudinal direction of a transfer sheet, and said transfer sheet and an ink ribbon of said ink cartridge are forwarded while being tightly held between said platen roller and said thermal head, so that ink of said ink ribbon is thermally transferred to said transfer sheet by means of said thermal head;

a guide member disposed in said ink cartridge, said guide member coming in contact with said ink ribbon all over a width of said ink ribbon;

a plurality of guiding portions formed in a surface of said guide member, said plurality of guiding portions extending in a forwarding direction; and a pad disposed in said ink cartridge, said pad sliding on a printed surface of said transfer sheet, so that dust adhering to said transfer sheet is removed.

2. A thermal printer according to claim 1, wherein said pad is the same in width as the ink ribbon.

3. A thermal printer according to claim 1, wherein said plurality of guiding portions are grooves, each groove spreading in a direction in which each groove recedes from a middle of said guide member with respect to the forwarding direction of said ink ribbon.

4. A thermal printer according to claim 1, wherein said plurality of guiding portions are inclined-surfaces which are inclined outwards from a middle of said guide member.

5. A thermal printer comprising a sprocket wheel, a platen roller, a motor drivingly connected with said sprocket wheel and platen roller, a transfer sheet having edge perforations, said sprocket wheel drivingly engaging said transfer sheet by engaging said edge perforations for moving said transfer sheet, a thermal head biased toward said platen roller, an ink cartridge having an ink ribbon moving with said transfer sheet, said transfer sheet and said ink ribbon being moved while tightly held between said platen roller and said thermal head to thermally transfer ink from said ink ribbon to said transfer sheet by said thermal head, said ink cartridge including a guide member contacting said ink ribbon over substantially the entire width of the ink ribbon, said guide member including a plurality of guiding portions formed in a surface of said guide member, said ink cartridge including a dust removing pad in sliding contact with the surface of said transfer sheet to remove adhering dust from the transfer sheet.

6. The thermal printer as defined in claim 5, wherein said pad is substantially the same width as the ink ribbon.

* * * * *